US005522450A

United States Patent [19]

Guttenbrunner

[11] Patent Number: 5,522,450

[45] **Date of Patent: *Jun. 4, 1996**

[54] CONTINUOUS CASTING PLATE MOLD

[75] Inventor: Josef Guttenbrunner, Sierning, Austria

[73] Assignee: Voest-Alpine Industrieanlagenbau GmbH, Austria

[ * ] Notice: The term of this patent shall not extend beyond the expiration date of Pat. No. 5,505,249.

[21] Appl. No.: 357,402

[22] Filed: Dec. 16, 1994

[30] Foreign Application Priority Data

Dec. 20, 1993 [AT] Austria ..... 2571/93

[51] Int. Cl.[6] ..... B22D 11/00; B22D 11/04

[52] U.S. Cl. ..... 164/418; 164/416

[58] Field of Search ..... 164/418, 459, 164/439, 490, 478, 416

[56] References Cited

U.S. PATENT DOCUMENTS

| | | | |
|---|---|---|---|
| 3,610,322 | 10/1971 | Schoffmann | 164/443 |
| 4,516,622 | 5/1985 | Thone et al. | 164/416 |
| 5,129,811 | 7/1992 | Grothe | 164/478 |
| 5,201,909 | 4/1993 | Von Wyl et al. | 164/418 |
| 5,297,612 | 3/1994 | Korpela et al. | 164/452 |

FOREIGN PATENT DOCUMENTS

| | | |
|---|---|---|
| 371388 | 6/1983 | Austria . |
| 0233796 | 4/1989 | European Pat. Off. . |
| 0417504 | 3/1991 | European Pat. Off. . |
| 3235673 | 4/1983 | Germany . |

*Primary Examiner*—P. Austin Bradley
*Assistant Examiner*—I. H. Lin
*Attorney, Agent, or Firm*—Ostrolenk, Faber, Gerb & Soffen

[57] ABSTRACT

A continuous casting plate mold includes an oscillating lifting table and parallel first side walls and second side walls capable of being clamped between the first side walls by a clamping device. The side walls are supported directly on the lifting table on both sides, i.e., without interposition of a water box. In order to be able to remove all of said side walls from the lifting table in a single operation and within a very short span of time as well as to enable a particularly light-weight construction of the lifting table, both of the second side walls are supported on at least one of the first side walls and on the lifting table via the same.

11 Claims, 1 Drawing Sheet

CONTINUOUS CASTING PLATE MOLD

BACKGROUND OF THE INVENTION

The invention relates to a continuous casting plate mold comprising an oscillating lifting table and parallel first side walls and second side walls capable of being clamped between the first side walls by a clamping means, which side walls are supported directly on the lifting table on both sides, i.e., without interposition of a water box.

From DE-A-32 35 673 a continuous casting plate mold is known, with which parallel first side walls and second side walls capable of being clamped between these first side walls by a clamping means are supported on a water box, the water box, in turn, being fastened to a lifting table. The first and second side walls each are fastened or supported directly on the water box in a manner that all of the side walls individually must be detached from the water box and removed from the same when removing these side walls.

A continuous casting mold without water box does have slightly larger and more stable side walls than a comparable mold incorporating a water box, yet its advantages predominate, which are to be seen in that its structure is more compact and simple because of the presence of fewer structural parts, that the overall structural weight and hence its production costs are substantially lower, that the accessibility for maintenance and adjustment works is enhanced and that a mold replacement is more simple and quick to carry out.

A continuous casting plate mold without water box of the initially defined kind to be used for casting strands having slab format is known from EP-B-0 233 796. With this known continuous casting mold, the two first side walls, which are designed as broad side walls, are mounted directly on a frame-shaped lifting table capable of being set in vertical lifting and lowering movements by means of an oscillation drive. The second side walls inserted between the broad side walls, which are designed as narrow side walls, each are supported on the lifting table via a special device that serves to adjust the position of the narrow side walls. Such devices are pivotably fastened to the lifting table in a manner that they can be brought into a position outside of the frame-shaped lifting table as seen from above, for the purpose of clearing the opening of the lifting table.

This construction involves the disadvantage that the side walls of the plate mold cannot readily be removed from the lifting table and replaced with new ones. For, with this known solution each of the broad side walls and each of the narrow side walls must be lifted off the lifting table separately. This is cumbersome and requires relatively much time.

With the mold known from EP-B-0 233 796, the broad side walls are displaceable relative to the lifting table for the purpose of clamping the narrow side walls, to which end displacement means especially arranged on the lifting table are provided. In order to be able to clear the lifting table completely, one is forced to remove these displacement means also separately. In doing so, it is disadvantageous that the clamping and straddling forces as well as the forces applied in format adjusting are transmitted onto the lifting table. This involves the danger of the lifting table being deformed and, thus, of the mold being expanded. Hence, an expensive and sturdy lifting table is required. Another disadvantage is to be seen in that none of the broad side walls serves as a fixed side, but that both of the broad side walls must be adjusted relative to the narrow side walls. If the strand casting format is to be altered in terms of thickness, both of the broad side walls will have to assume new positions relative to the lifting table and hence also new positions relative to the strand guide provided below the lifting table. This implies cumbersome adjustment works.

From EP-A-0 417 504 also a continuous casting mold without water box is known, with which a device for adjusting the narrow side walls likewise is arranged on the lifting table, i.e., is rigidly fastened thereto. The broad side walls are supported on this device and, thus, are mounted on the lifting table not directly, but by this device being interposed. The two broad side walls are adjustable relative to the narrow side walls in a manner that also this construction does not offer any possibility to configure one of the broad side walls as a fixed side.

SUMMARY OF THE INVENTION

The invention aims at avoiding these disadvantages and difficulties and has as its object to provide a continuous casting plate mold of the initially defined kind, which can be removed from the lifting table in a single operation as a whole, i.e., while taking away all of the side walls and, preferably, all of the auxiliary devices (such as clamping mechanisms, adjusting mechanisms, etc.) such that a mold exchange, for instance, in case of a failure or with a view to changing format can be realized in a simple manner and within a very short span of time. With the continuous casting plate mold it is to be feasible, in particular, to configure one of the first side walls as a fixed side in a simple manner. In addition, the lifting table is to be designable with a simple and light-weight structure and is to offer completely free access to plant parts arranged below the lifting table after removal of the continuous casting mold.

In accordance with the invention, this object is achieved in that both of the second side walls are supported on at least one of the first side walls and on the lifting table via the same, one of the first side walls in at least one end region advantageously being provided with a cantilever beam carrying one of the second side walls.

A particularly suitable embodiment is characterized in that a first side wall in both end regions is provided with a cantilever beam each carrying a second side wall, this first side wall being fixed on the lifting table as a fixed side wall.

The continuous casting plate mold according to the invention offers the opportunity of forming the clamping means by tie connection means supported on both of the first side walls, such as a pressure medium cylinder. This enables clamping of the narrow side walls without having to provide therefor a special device on the lifting table, which means that the lifting table can be kept clear from such device, the clamping means being removed from the lifting table together with the continuous casting mold when removing the latter.

Preferably, the two first side walls are guided on each other via the cantilever beams, wherein suitably both the cantilever beam and the first side wall to be guided on the cantilever beam are guided on each other by contiguous guiding surfaces. Hence results a particularly compact structural unit of the continuous casting plate mold.

Suitably, the lifting table is designed as a one-part frame. According to another preferred embodiment, the lifting table is formed by two synchronously oscillating beams extending transverse to the first side walls. This embodiment of the lifting table renders possible further reduction in weight and can be realized with the continuous casting plate mold according to the invention in a particularly simple manner because of the side walls of the plate mold forming a compact structural unit such that the lifting table broad sides present with a frame-shaped lifting table may readily be obviated.

Suitably, the cantilever beams carry position adjusting means for the second side walls.

Advantageously, the supply of the first and second side walls is effected via plug connections arranged, by one part, on the lifting table and, by counter pieces, on the end regions of the first side walls, and for the second side walls, on the cantilever beams.

BRIEF DESCRIPTION OF THE DRAWING

In the following, the invention will be explained in more detail by way of the accompanying drawing, wherein.

DESCRIPTION OF THE PREFERRED EMBODIMENT

Figure 3:
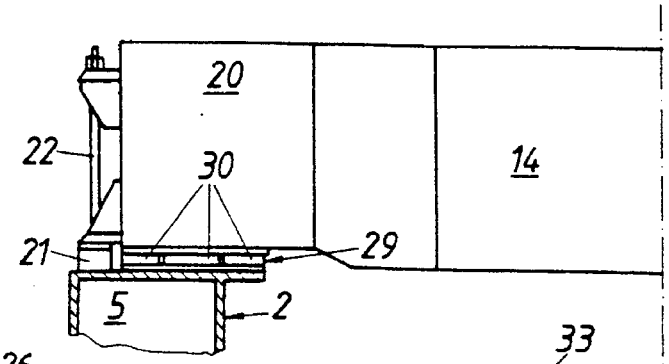
FIG. 3 is an illustration of a section led along line III—III of FIG. 2, all of the Figures merely representing the left-hand half of a plate mold designed symmetrical with respect to its median line.
Figure 1:
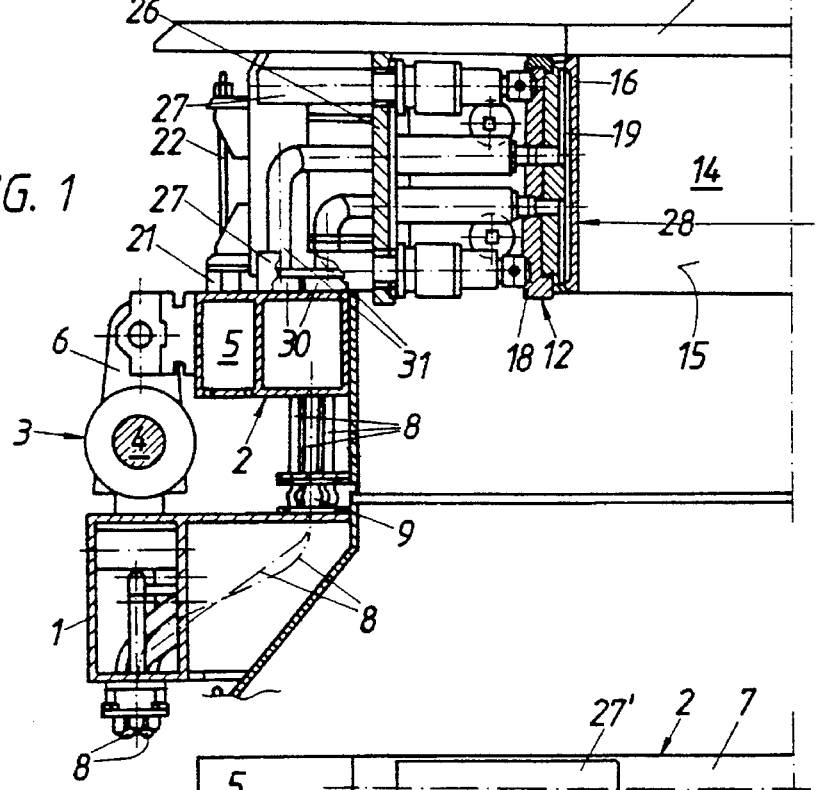
FIG. 1 schematically illustrates a central vertical section parallel to the first side walls of a continuous casting plate mold.
Figure 2:
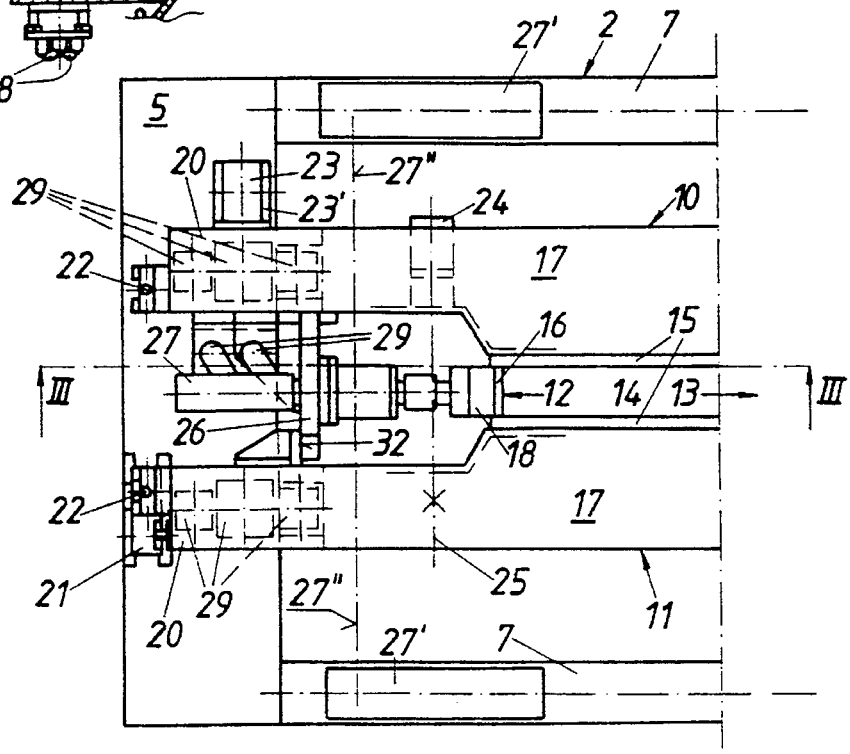
FIG. 2 is a top view on the continuous casting mold.

A lifting table 2, which is designed in a frame-like manner according to the exemplary embodiment illustrated, is supported on beams 1 stationarily arranged on a base, via an oscillation drive 3. The oscillation drive 3 comprises eccentric shafts 4 extending along the short sides 5 of the rectangular lifting table 2 and setting the lifting table in a vertical lifting and lowering movement via brackets 6 hinged to the lifting table 2. In order to guide the lifting table 2 strictly in the vertical direction, guide elements (not illustrated) are provided between the lifting table 2 and the stationary beams 1.

The short sides 5 of the lifting table 2 are designed as box sections and are connected to form a frame structure by means of I-beams constituting the longitudinal sides 7 of the lifting table 2. Supply ducts 8, such as, for instance, coolant supply and discharge ducts, lead to the lifting table 2 via the stationary beams 1 by means of elastic connection elements 9.

The side walls 10 to 13 of the continuous casting plate mold are supported on the lifting table 2 without interposition of a water box. All of the side walls 10 to 13 are configured as individual plates, first side walls 10, 11, in the following denoted as broad side walls, being directly supported on the lifting table 2 and second side walls 12, 13, in the following denoted as narrow side walls, being clampable between the broad side walls 10, 11. All of the side walls are formed by inwardly arranged copper plates 15, 16 and supporting plates 17, 18 supporting the former, coolant channels 19 each being provided between the copper plates 15, 16 and the pertaining supporting plates 17, 18.

The supporting plates 17 of the broad side walls 10, 11, by their end regions 20, extend as far as to above the short sides 5 of the lifting table 2. By these end regions 20, they rest on bearing blocks 21 arranged on the lifting table 2 on its upper side and are clampable against the lifting table 2 by a clamping means designed as a tension rod 22. One of the broad side walls, namely wall 10, is designed as a so-called fixed side wall, i.e., it assumes a precisely defined position relative to the lifting table 2, whereas the opposite broad side wall 11 is displaceable in a direction perpendicular to the fixed side wall 10 and is fixable in different positions. For centering the broad side wall 10 forming the fixed side wall 10, centering elements 23 are provided on the lifting table 2 and counter elements 23' are provided in the end regions 20 of the broad side wall 10.

To carry out a translatory movement of the broad side wall 11, at which the narrow side walls 12, 13 can be clamped between the broad side walls 10, 11 or are released upon straddling, clamp means 24 provided in the end regions 20 of the fixed side wall, such as, for instance, pressure medium cylinders, serve, which contact the opposite broad side wall 11 by their piston rods 25, drawing the same towards the fixed side wall 10 or moving it away therefrom.

The fixed side wall 10, in its end regions 20 extending over the short sides 5 of the lifting table 2, comprises a cantilever beam 26 each, which is directed to the oppositely arranged broad side wall 11. A narrow side wall 12 or 13, respectively, is each supported on a cantilever beam 26 by means of a spindle drive 27, which serves to adjust the position of a narrow side wall 12 or 13, respectively, to a predetermined strand width 28 and/or to adjust a desired conicity. Electromotors 27' mounted on the lifting table and connected with the spindle drives 27 via articulated shafts 27" in a known manner serve to actuate the spindle drives.

The supply of the broad side walls 10, 11 and of the narrow side walls 12, 13 with coolant is effected via plug connection means 29, one part 30 of which is each arranged on the lifting table 2, namely on its short sides 5, and the respective counter piece 31 of which is each arranged in the end regions 20 of the broad side walls 10, 11 and on the cantilever beam 26 (for the narrow sides 12, 13), respectively. Connection occurs automatically by placing the side walls 10 to 13 on the lifting table 2, thus causing the counter pieces 31 to get into engagement positions with parts 30. The automatic $H_2O$-connections on either side may be configured both as rubber compression (pressure) connection means and as plug connection means, preferably as plug connection means on the loose side.

The broad side wall 11 that is displaceably supported on the lifting table 2 is guided relative to the fixed side wall 10 via guiding surfaces 32 provided on the cantilever beam 26 as well as in the end regions 20 of the broad side wall 11; upon displacement into the right position, i.e., upon clamping of the narrow side walls 12, 13, it may be clamped against the lifting table 2 by means of the tension rods 22.

The continuous casting plate mold according to the invention renders feasible the use of a lifting table 2 that is designed to be substantially less sturdy than has been common so far. Since the broad side walls 10, 11 are supported directly on the short sides 5 of the lifting table, which means that the flow of force occurs almost linearly from the side walls 10 to 13 of the mold through the lifting table 2 via the oscillation drive 3 towards the stationary beam 1, the cross section of the short sides 5 of the lifting table 2 may be kept small. According to the invention, the longitudinal sides 7 connecting the short sides of the lifting table may be comprised of I-beams welded in between the short sides 5, which results in a particularly simple and light-weight construction of the lifting table 2. The lifting table 2 need not form a closed frame; it may as well be open or comprised of several parts, for instance, it may be formed merely by the short sides 5. In such a case, it merely must be taken care that the short sides 5 of the lifting table 2 oscillate synchronously.

Another substantial advantage of the continuous casting plate mold according to the invention is to be seen in that, after having released the means 22 clamping the broad side walls 10 and 11 onto the lifting table 2, the side walls 10 to 13 can be lifted off the lifting table 2 all at once, no means whatsoever remaining on the lifting table 2 except for the centering elements 23 for centering the fixed side wall 10 on the lifting table 2 and the relatively expensive electromotors 27'. All of the coolant connection means suitably are configured in a manner that their connection will be ensured automatically when placing the side walls 10 to 13 of the mold on the lifting table 2.

From what has been said above, it follows that a mold exchange, say for the purpose of replacing a defect mold or for the purpose of altering the format, is feasible in a particularly simple manner and within a very short time, wherein a mold cover 33 need not be removed separately, either, because the mold cover 33 rests on the side walls 10 to 13 and is centered via the fixed side wall 10. Hence result short assembly times and a high availability of the plate mold.

The structure according to the invention allows for the conversion of an existing continuous casting plant in which, for instance, the displaceability of the narrow side walls 12, 13 has been renounced in the beginning for cost reasons, by exchanging its side walls for side walls 10 to 13 offering such displaceability, no modification whatsoever being required at the lifting table 2.

The invention is not limited to the exemplary embodiment illustrated in the drawing, but may be modified in various aspects. Thus, it is possible to provide a cantilever beam 26 carrying a narrow side wall 12 or 13, respectively, on one of the broad side walls 10 and 11 each.

What I claim is:

1. In a continuous casting plate mold arrangement of the type including a continuous casting plate mold, an oscillating lifting table, two parallel first side wall means and two second side wall means capable of being clamped between said two first side wall means, said first side wall means and said second side wall means on both sides being directly supported on said lifting table without interposition of a water box, and a clamping means adapted to clamp said second side wall means between said first side wall means, the improvement wherein said second side wall means are both supported on at least one of said first side wall means and on said lifting table via said at least one of said first side wall means.

2. A continuous casting plate mold arrangement as set forth in claim 1, wherein said lifting table is designed as a one-part frame.

3. A continuous casting plate mold arrangement as set forth in claim 1, wherein said lifting table is comprised of two synchronously oscillating beams extending transverse to said first side wall means.

4. A continuous casting plate mold arrangement as set forth in claim 1, wherein said clamping means is formed by a tie connection means supported on both of said first side wall means.

5. A continuous casting plate mold arrangement as set forth in claim 4, wherein said tie connection means is comprised of a pressure medium cylinder.

6. A continuous casting plate mold arrangement as set forth in claim 1, further comprising a cantilever beam means provided on one of said first side wall means in at least one of its end regions, said cantilever beam means being adapted to carry a second side wall means.

7. A continuous casting plate mold arrangement as set forth in claim 6, further comprising position adjustment means provided on said cantilever beam means for said second side wall means.

8. A continuous casting plate mold arrangement as set forth in claim 6, further comprising plug connection means including a first connection part arranged on said lifting table and a first counter connection piece arranged on said first side wall means in its end regions for feeding said first side wall means and a second counter connection piece arranged on said cantilever beam means for feeding said second side wall means.

9. A continuous casting plate mold arrangement as set forth in claim 6, wherein said cantilever beam means is provided on one of said first side wall means in both of its end regions, each of said cantilever beam means being adapted to carry a second side wall means and said one of said first side wall means being fixed on said lifting table as a fixed side wall.

10. A continuous casting plate mold arrangement as set forth in claim 9, wherein both of said first side wall means are guided on each other via said cantilever beam means.

11. A continuous casting plate mold arrangement as set forth in claim 10, further comprising contiguous guiding surface means provided both on said cantilever beam means and on said one of said first side wall means to be guided on said cantilever beam means, for guiding said cantilever beam means on said first side wall means.

* * * * *